United States Patent [19]

Kawano et al.

[11] Patent Number: 4,804,409

[45] Date of Patent: Feb. 14, 1989

[54] ALLOY STEEL POWDER FOR POWDER METALLURGY

[75] Inventors: Masaki Kawano; Kuniaki Ogura; Teruyoshi Abe; Shigeaki Takajo, all of Chiba, Japan

[73] Assignee: Kawasaki Steel Corporation, Hyogo, Japan

[21] Appl. No.: 117,151

[22] PCT Filed: Jul. 11, 1987

[86] PCT No.: PCT/JP87/00501

§ 371 Date: Sep. 11, 1987

§ 102(e) Date: Sep. 11, 1987

[87] PCT Pub. No.: WO88/00505

PCT Pub. Date: Jan. 28, 1988

[30] Foreign Application Priority Data

Jul. 11, 1986 [JP] Japan ..... 162098

[51] Int. Cl.[4] ..... C22C 38/08

[52] U.S. Cl. ..... 75/246; 420/92; 420/119

[58] Field of Search ..... 75/246, 251; 420/92, 420/119

[56] References Cited

U.S. PATENT DOCUMENTS

| | | | |
|---|---|---|---|
| Re. 28,523 | 8/1975 | Hill et al. | 420/119 |
| 4,049,429 | 9/1977 | Donachie . | |
| 4,505,988 | 3/1985 | Urano et al. . | |
| 4,552,590 | 11/1985 | Nakata et al. . | |
| 4,561,893 | 12/1985 | Takajo | 420/92 |
| 4,664,706 | 5/1987 | Drozda . | |
| 4,702,771 | 10/1987 | Takagi et al. . | |

*Primary Examiner*—John F. Terapane
*Assistant Examiner*—Eric Jorgensen
*Attorney, Agent, or Firm*—Austin R. Miller

[57] ABSTRACT

The improvement of strength and hardness of steel powders can be realized under good compressibility by alloying 0.2~2.0 wt. % of W and 0.8~3.0 wt. % of Ni, and further 0.1~1.0 wt. % of Mo or 0.2~2.0 wt. % of Cu in steel powder, and further the reduction of dimensional deviation introduced by heat treatment after sintering can also be achieved. This substantially eliminates damaging the shape and size of the sintered body after heat treatment.

8 Claims, 2 Drawing Sheets

ALLOY STEEL POWDER FOR POWDER METALLURGY

TECHNICAL FIELD

This invention relates to an alloy steel powder for powder metallurgy used in the manufacture of various sintered parts.

BACKGROUND ART

It has hitherto been known that sintered materials are obtained by using pure iron powder as a main starting material. However, the tensile strength of such a sintered material is about 30–40 kgf/mm$^2$, which is a low level of mechanical strength, so that the application thereof is undesirably restricted to low load pulleys and the like.

As a means for solving the above drawback, there is developed a technique of utilizing an alloy steel powder obtained by soluting various alloying ingredients such as Mn, Ni, Cr and Mo into powdery particles (for example, reference may be made to Japanese patent application publication No. 49-28,827).

In such an alloy steel powder, however, it is possible to raise the strength of steel powder itself through alloying, but the plastic deformation in the forming process becomes difficult with the rise of the strength to impede the compressibility, and it is necessary to degrade the strength of the sintered body due to the reduction of the sintered density. Therefore, the resulting sintered body has not sufficient mechanical properties.

DISCLOSURE OF INVENTION

In order to attempt the improvement of the strength by alloying, therefore, it is important to select alloying ingredients and their composition ranges so as not to impede the compressibility of the ferrous powder as far as possible.

As the other important properties in sintered mechanical parts obtained through molding-sintering-heat treatment, there are mentioned a hardened dimensional deviation through heat treatment after the sintering and a hardness.

In general, it is appropriate to select alloying ingredients giving excellent hardenability for providing sufficient hardness. On the other hand, the strain through heat treatment is mainly caused by the amount of phase transformation in the heat treatment, i.e. the amount of martensitic transformation and the microscopic or macroscopic scattering of residual austenite, so that the hardening transformed dimensional deviation becomes generally larger in the composition having good hardenability, which tends to make the change of shape and size large.

Up to now, the planning of steel powder is exclusively made from viewpoints of mechanical properties of the sintered body such as hardness, strength, toughness and so on. On the other hand, sufficient examinations are not made from a viewpoint of effective steel powder composition for powder metallurgy capable of reducing the strain through heat treatment after sintering and improving the hardness of the sintered body.

For instance, Japanese Patent Application publication No. 55-36,260 discloses an Fe-base sintered body containing Ni and W or Ni, W and Mo and a method of producing the same. The invention disclosed in this publication is designed to obtain high strength, high toughness sintered bodies by fundamentally mixing iron powder with metal powders as an alloying ingredient.

This invention is developed under the aforementioned situations, and is to propose alloy steel powders for powder metallurgy which are easy in plastic deformation during forming, excellent in compressibility, high in sintered density, less in hardened dimensional deviation through heat treatment, high in hardness after heat treatment of the sintered body and useful as a starting material for the sintered body requiring high strength and hardness in gears of automobile transmissions or the like.

The inventors have made various studies in order to solve the above problems and found that the foregoing objects are advantageously achieved by utilizing W and Ni, and further Mo or Cu as an alloying ingredient for steel powder. The invention is based on this finding.

That is, the essential construction of the invention is as follows.

(i) An alloy steel powder for powder metallurgy, consisting of W: 0.2~2.0 wt % (hereinafter simply shown as %), Ni: 0.8~3.0% and the balance being substantially Fe except for inevitable impurities (first invention).

(ii) An alloy steel powder for powder metallurgy, consisting of W: 0.2~2.0%, Ni: 0.8~3.0%, Mo: 0.1~1.0% and the balance being substantially Fe except for inevitable impurities (second invention).

(iii) An alloy steel powder for powder metallurgy, consisting of W: 0.2~2.0%, Ni: 0.8~3.0%, Cu: 0.2~2.0% and the balance being substantially Fe except for inevitable impurities (third invention).

(iv) An alloy steel powder for powder metallurgy, consisting of W: 0.2~2.0%, Ni: 0.8~3.0%, Mo: 0.1~1.0%, Cu: 0.2~2.0% and the balance being substantially Fe except for inevitable impurities (fourth invention).

The invention will be concretely described below.

At first, the reason why the composition of the alloy steel powder according to the invention is limited to the above ranges will be described. W: 0.2~2.0%

Since an oxide forming from W has an easy reducing property, the oxide is easily reduced even when performing cheap water-atomizing process, and decarburization by usual reduction is easy to reduce C, O in steel powder as a factor impeding the compressibility, so that W effectively contributes to the improvement of compressibility. Furthermore, W is an element enhancing the hardenability and forming a hard carbide, so that it has an advantage that the hardness of the resulting sintered body is enhanced by forming a carbide with C in steel powder through heat treatment such as carburization hardening or the like usually used in a sintered body. Moreover, since carbide is formed, a microstructure is produced which is less in the C content of matrix, that is, less in strain of the crystal lattice, such as a low carbon martensite structure or the like, so that the effect of reducing the strain after heat treatment is also produced.

However, when the W content is less than 0.2%, the contribution to enhance hardness in the heat treatment of the sintered body is small, while when it exceeds 2%, not only the degradation of compressibility of steel powder is conspicuous, but also the formation of carbide is accelerated in the heat treatment of the sintered body to reduce the C content in matrix and hence the hardness of the sintered body. Therefore, the W content is limited to a range of 0.2~2.0%, preferably 0.2~1.6%. Ni: 0.3~3.0%

Ni is useful as a solution element restraining the coarsening of austenite crystal grains and reinforcing the matrix, and also contributes to effectively suppress carburization in the heat treatment such as carburization hardening or the like to reduce the strain of the sintered body after heat treatment.

However, when the Ni content is less than 0.8%, the matrix effective for the sintered body be reinforced, while when it exceeds 3.0%, not only is the compressibility of steel powder reduced, but also the increase of austenite remaining in the sintered body during heat treatment becomes conspicuous to increase the strain through heat treatment. Therefore, the Ni content is limited to a range of 0.8~3.0%, preferably 1.0~2.5%.

Although the above has been described with respect to the fundamental components, Mo and Cu may further be added alone or in admixture according to the invention. Mo: 0.1~1.0%

Mo is a carbide-forming element like W. It forms a carbide in steel to enhance hardenability, and acts to increase the addition effect of W. Furthermore, the addition of Mo does not undesirably increase the strain through heat treatment.

However, if the Mo content is less than 0.1%, the effect of enhancing hardenability is poor and hence the contribution to the increase of hardness through heat treatment of the sintered body is small, while if it exceeds 1.0%, the degradation of compressibility of the steel powder is caused. Therefore, Mo is added in an amount of 0.1~1.0%, preferably 0.2~0.8%. Cu: 0.2~2.0%

Cu effectively contributes to the enhancement of hardenability with the carbide-forming elements such as W, Mo or the like. However, if the Cu content is less than 0.2%, the effect of enhancing hardenability is poor and hence the contribution to the increase of hardness through heat treatment of the sintered body is small, while if it exceeds 2.0%, the increase of residual austenite quantity after heat treatment is caused to increase the strength and the strain through heat treatment. Therefore, Cu is added in an amount of 0.2~2.0%, preferably 0.2~1.0%. Moreover, the addition of Cu does not increase the strain through heat treatment, as is the case of adding Mo.

In case of using Cu, it is favorable that the total amount of Cu and Ni is within a range of 1.0~2.5%. When the total amount is less than 1.0%, the matrix of the sintered body cannot effectively be reinforced, while when it exceeds 2.5%, not only is the compressibility of steel powder reduced, but also the increase of austenite remaining in the sintered body during heat treatment becomes undesirably conspicuous to increase the strain through heat treatment.

In the production of the alloy steel powder according to the invention, since the alloying powder according to the invention does not substantially contain reducing elements such as Cr, Mn or the like, the cheap water-atomizing.gas reducing process may advantageously be applied. Moreover, although the production of alloy steel powder according to the invention is not limited to the aforementioned water-atomizing gas reducing process, any other well-known processes may naturally be used.

BEST MODE OF CARRYING OUT THE INVENTION

Example 1

A steel powder containing W and Ni as an alloying ingredient was prepared by a water atomizing process, and was annealed in a hydrogen gas atmosphere at 1,000° C. for 60 minutes. The resulting alloy steel powder was sieved through 60 mesh and zinc stearate was added in an amount of 0.75%. The product was then formed into a green body under a forming pressure of 7 ton/cm$^2$.

As to the chemical composition, the Ni content was 1.0%, while the W content was varied within a range of 0.2% to 2.5%. The thus obtained green densities are shown in FIG. 1.

Figure 1:
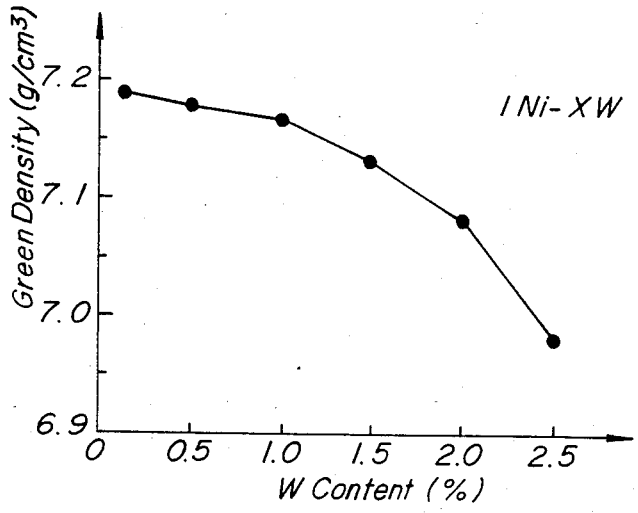
FIG. 1 is a graph showing the relation between W content in steel powder and green density when the alloy steel powder containing W and Ni is molded into a green body.

As seen from FIG. 1, when the W content in steel powder exceeds 2%, the compressibility rapidly lowers, while when it satisfies the proper range defined in the invention, excellent compressibility is obtained with a green density of not less than 7.0 g/cm$^3$.

Example 2

Figure 2:
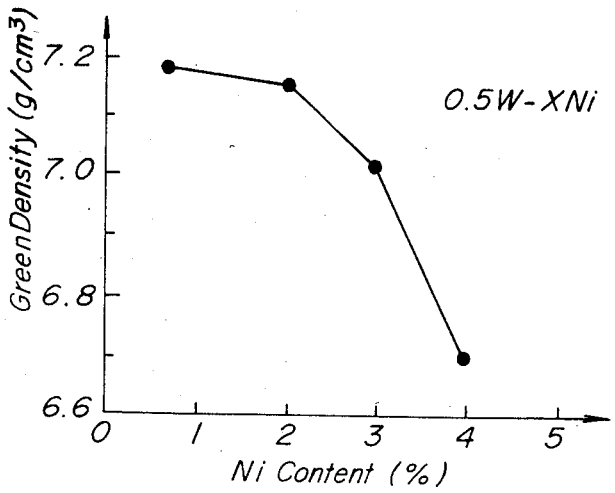
FIG. 2 is a graph showing the relation between Ni content in steel powder and green density when the alloy steel powder containing W and Ni is molded into a green body.

A steel powder having a constant W content of 0.5% and a variable Ni content of 0.8% to 4% was prepared by the same method as described in Example 1, and was formed into a green body under the same condition as described in Example 1 to obtain a green density as shown in FIG. 2.

As seen from FIG. 2, when the Ni content in steel powder exceeds 3%, the compressibility rapidly lowers, while when it is within a range of 0.8~3.0% as a proper range defined in the invention, the excellent compressibility is obtained with a green density of not less than 7.0 g/cm$^3$.

EXAMPLE 3

Figure 3:
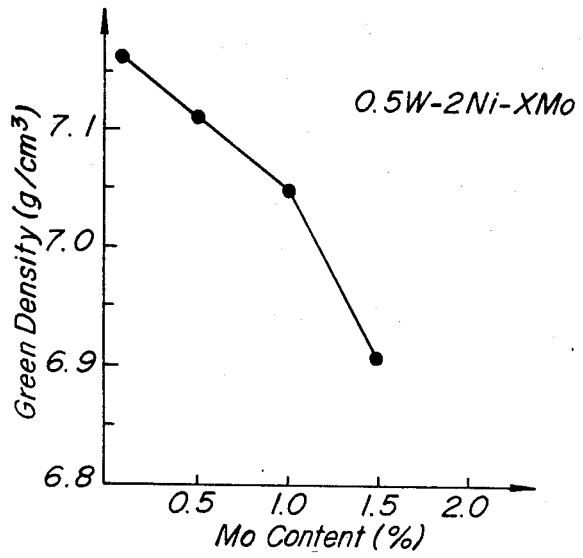
FIG. 3 is a graph showing the relation between Mo content in steel powder and green density when the alloy steel powder containing W, Ni and Mo is molded into a green body.

A steel powder having a constant W content of 0.5%, a constant Ni content of 2% and a variable Mo content of 0.1% to 1.5% was prepared by the same method as described in Example 1, and was formed into a green body under the same condition as described in Example 1 to obtain a green density as shown in FIG. 3.

As seen from FIG. 3, when the Mo content exceeds 1.0%, the compressibility largely lowers, while when it is within a range of 0.1~1.0% satisfying the proper range defined in the invention, the excellent compressibility is obtained with a green density of not less than 7.0 g/cm$^3$.

EXAMPLE 4

An alloy steel powder having a chemical composition as shown in Table 1 was prepared by the same method as described in Example 1. The green density of the resulting green body as well as the standard deviation in size change through heat treatment and hardness of the sintered body obtained by sintering the steel powder and subjecting to the heat treatment were measured to obtain results as shown in Table 1.

The measurements of the size change and hardness are as follows. That is zinc stearate was added to, the steel powder in an amount of 0.75% and formed into a tablet of Φ60×20 mm having a green density of 7.0 g/cm$^3$, which was then sintered in an AX gas atmosphere at 1,150° C. for 60 minutes and subjected to carburization and oil hardening in an atmosphere having a carbon potential of 0.7%. With respect to the heat-treated sintered body, the outer diameters falling at right angles with each otherwere measured and the difference therebetween was calculated as a standard deviation, which was an indication of strain scattering through heat treatment, while the hardness of the resulting sintered body surface was measured.

As is apparent from Table 1, all of the alloy steel powders according to the invention (Sample Nos. 1~8) are good in compressibility, very small in dimensional deviation introduced by heat treatment of the sintered body, and excellent in hardness after heat treatment. Particularly, in samples Nos. 5~8 containing Mo and/or Cu, the hardness was more greatly improved.

TABLE 1

| Sample No. | Steel powder: Chemical composition (%) C | W | Ni | Mo | Cu | Si | Mn | P | S | O | N | Green density (g/cm$^3$) | Sintered body: Standard deviation of strain difference in heat treatment*1 $\sigma_{n-1}$ (μm) | Vickers hardness Hv | Remarks |
|---|---|---|---|---|---|---|---|---|---|---|---|---|---|---|---|
| 1 | 0.002 | 1.02 | 1.51 | — | — | 0.008 | 0.14 | 0.012 | 0.008 | 0.03 | 0.0012 | 7.15 | 2.4 | 625 | First invention |
| 2 | 0.003 | 1.51 | 2.02 | — | — | 0.009 | 0.19 | 0.009 | 0.009 | 0.04 | 0.0011 | 7.13 | 2.3 | 655 | First invention |
| 3 | 0.003 | 0.53 | 2.03 | 0.52 | — | 0.014 | 0.16 | 0.010 | 0.014 | 0.02 | 0.0016 | 7.12 | 3.6 | 620 | Second invention |
| 4 | 0.003 | 0.55 | 0.91 | 0.14 | — | 0.009 | 0.21 | 0.013 | 0.021 | 0.06 | 0.0015 | 7.14 | 2.6 | 598 | Second invention |
| 5 | 0.002 | 1.50 | 2.02 | 0.53 | — | 0.012 | 0.12 | 0.005 | 0.012 | 0.05 | 0.0014 | 7.05 | 3.8 | 670 | Second invention |
| 6 | 0.002 | 1.80 | 2.53 | 0.95 | — | 0.018 | 0.08 | 0.007 | 0.018 | 0.05 | 0.0018 | 7.00 | 4.2 | 702 | Second invention |
| 7 | 0.003 | 1.10 | 1.55 | — | 0.52 | 0.013 | 0.11 | 0.009 | 0.009 | 0.03 | 0.0020 | 7.14 | 3.3 | 636 | Third invention |
| 8 | 0.003 | 1.50 | 1.56 | 0.50 | 0.55 | 0.007 | 0.20 | 0.008 | 0.008 | 0.04 | 0.0012 | 7.04 | 2.5 | 670 | Fourth invention |
| 9 | 0.003 | — | 2.03 | 0.50 | — | 0.015 | 0.15 | 0.014 | 0.007 | 0.05 | 0.0012 | 7.14 | 7.1 | 595 | Comparative Example |
| 10 | 0.002 | 2.54 | 3.45 | 1.35 | 2.51 | 0.011 | 0.22 | 0.021 | 0.011 | 0.07 | 0.0009 | 6.85 | 11.6 | 791 | Comparative Example |

*1Measuring number: 20

INDUSTRIAL APPLICABILITY

According to the invention, alloy steel powders for powder metallurgy having excellent strength and hardness and being subject to less change of shape and size through heat treatment after the annealing can be obtained without causing degradation of compressibility, so that they are more advantageously adaptable as starting materials for producing sintered mechanical parts such as gears of automobile transmissions and so on requiring not only high strength and hardness but also a highly precise size.

We claim:

1. An alloy steel powder for powder metallurgy, consisting of

W: 0.2~2.0 wt % and
Ni: 0.8~3.0 wt % and the balance being substantially Fe except for impurities.

2. The alloy steel powder according to claim 1, wherein each amount of W and Ni as an alloying ingredient is W: 0.2~1.6 wt %,
Ni: 1.0~2.5 wt %.

3. An alloy steel powder for powder metallurgy, consisting of

W: 0.2~2.0 wt %,
Ni: 0.8~3.0 wt % and
Mo: 0.1~1.0 wt % and the balance being substantially Fe except for impurities.

4. The alloy steel powder according to claim 3, wherein each amount of W, Ni and Mo as an alloying ingredient is W: 0.2~1.6 wt %,
Ni: 1.0~2.5 wt %,
Mo: 0.2~0.8 wt %.

5. An alloy steel powder for powder metallurgy, consisting of

W: 0.2~2.0 wt %,
Ni: 0.8~3.0 wt % and
Cu: 0.2~2.0 wt % and the balance being substantially Fe except for impurities.

6. The alloy steel powder according to claim 5, wherein each amount of W, Ni and Cu as an alloying ingredient is W: 0.2~1.6 wt %,
Ni: 1.0~2.5 wt %
Cu: 0.2~1.0 wt %, and wherein the amount of Ni+Cu is 1.0~2.5 wt %.

7. An alloy steel powder for powder metallurgy, consisting of

W: 0.2~2.0 wt %,
Ni: 0.8~3.0 wt %,
Mo: 0.1~1.0 wt % and
Cu: 0.2~2.0 wt % and the balance being substantially Fe except for impurities.

8. The alloy steel powder according to claim 7, wherein each amount of W, Ni, Mo and Cu as an alloying ingredient is W: 0.2~1.6 wt %
Ni: 1.0~2.5 wt %,
Mo: 0.2~0.8 wt %,
Cu: 0.2~1.0 wt %, and wherein the amount of Ni+Cu is 1.0~2.5 wt %.

* * * * *